United States Patent [19]

Buljovcic

[11] 4,048,922

[45] Sept. 20, 1977

[54] SELF-FRAGMENTABLE BULLET

[75] Inventor: Stephan Buljovcic, Versailles, France

[73] Assignee: Rene Cosson S.A., Paris, France

[21] Appl. No.: 692,215

[22] Filed: June 2, 1976

[30] Foreign Application Priority Data

June 3, 1975 France ..... 75.17308

[51] Int. Cl.[2] ..... F42B 11/18

[52] U.S. Cl. ..... 102/92.7

[58] Field of Search ..... 102/91, 92.1–92.7; 244/3.1

[56] References Cited

U.S. PATENT DOCUMENTS

| | | | |
|---|---|---|---|
| 2,364,197 | 12/1944 | Dee | 244/3.1 |
| 3,019,733 | 2/1962 | Braid | 102/91 |
| 3,289,585 | 12/1966 | Rudolph et al. | 102/91 |
| 3,427,976 | 2/1969 | Lucy | 102/91 |
| 3,941,059 | 3/1976 | Cobb | 102/91 |

FOREIGN PATENT DOCUMENTS

| | | | |
|---|---|---|---|
| 411,485 | 8/1945 | Italy | 244/3.1 |
| 221,542 | 8/1968 | U.S.S.R. | 244/3.1 |

*Primary Examiner*—Verlin R. Pendegrass
*Attorney, Agent, or Firm*—Keil, Thompson & Shurtleff

[57] ABSTRACT

A self-fragmentable bullet is provided in the form of a block comprising a central core and a peripheral portion surrounding said central core composed of a plurality of panels separated by weakened zones or zones of minimum resistance, the block being traversed along its longitudinal axis by passages. This bullet is especially useful in smooth barrel firearms for hunting and target practice.

10 Claims, 4 Drawing Figures

SELF-FRAGMENTABLE BULLET

The present invention relates to a self-fragmentable bullet for smooth barrel firearms of all calibers and especially for hunting and target practice.

Bullets which are in a cylindrical form with a conical head and a tail of flock, or the like are known. The openings that such bullets create in penetrating the body of an animal are nevertheless limited to a single diameter with the result that the hemorrhaging provoked is relatively weak and large game runs quite a distance before dying.

Expandable bullets are also known which have a hollow bottom and which are fired with the bottom forward with the result that the hollow part is deformed and the diameter increased slightly. The opening or passage created by such bullets in the body of an animal is more substantial than in the preceding case but still relatively limited.

Sleeved bullets are also known which are formed in two parts, the rear core and a forward deformable zone, the bullet being disposed in the interior of a sleeve or wrapper. German Patent Publication No. 2,223,212 describes bullets of the "sleeved" type. Nevertheless, these bullets present numerous disadvantages: first they require the use of rifle or grooved firearms, their precision being limited by the gyroscopic effect created by helicoidal grooves disposed along the firearm barrel; then these bullets are not monolithic which increases their cost; moreover they are deformable but not fragmentable; finally, they comprise no central core, no metal end, no axial passages traversing the bullet from end to end so that the stability of their projectory is variable.

One of the objects of the invention is to provide a bullet which creates a passage more substantial and enlarged thereby producing hemorrhaging and traumatism.

Another object of the invention is to provide a self-fragmentable bullet characterized by the fact that it is made in the form of a block comprising a central core and a peripheral part surrounding the latter and consisting of a plurality of panels separated by zones of minimum resistance, the said block being traversed from end to end, along the direction of its axis by passages.

Thus, when the bullet penetrates into the body of an animal these panels, due to the effect of the resistance encountered, separate from one another along the lines of least resistance, thereby considerably increasing the cross section of the bullet. Furthermore, passages traversing the bullet assure great stability in its trajectory as a result of the air flow.

In one particularly advantageous embodiment of the invention the peripheral part consists of a cylindrical skirt mounted on the central core by radial linking bars. This arrangement permits very good opening of the panels while creating in addition stabilizing passageways.

It may be noted the essential characteristics of the bullet according to the invention are: that it be a monoblock; that it be self-fragmentable; and that it be stable all along its firing trajectory.

A bullet according to the invention is distinguished very clearly from other fragmentable bullets of the type described in French Pat. No. 1,401,792, bullets which are characterized by being self-fragmentable because they are always associated with a suppletary member called "spacer" which is introduced into the boring of the head of the bullet and which thrusts into the said boring toward the rear of the bullet at the moment of impact, thereby provoking a separation of the sectors of the head.

It is evident that the addition of the spacer complicates the formation and fabrication of the fragmentable bullet. This addition is equally an important economic consequence; since the projectile is in two parts, its cost of manufacture is approximately nearly double that of the self-fragmentable bullet of the present invention.

This addition of a spacer has another unfortunate consequence; the bullet is not in equilibrium during its trajectory and it must, on the contrary, follow a gyroscopic trajectory.

In effect, either the spacer is not perforated and it must therefore, due to the helicoidal grooves on the exterior side of the bullet, produce rotation around its longitudinal axis; or the spacer is perforated and it issues to the right of the internal helicoidal grooves which assure the maintenance of a trajectory of the bullet by a gyroscopic effect.

In conclusion, the anterior fragmentable bullet, which is fragmented by means of an additional spacer, is not a monoblock, on the one hand, and on the other hand, is not kept preferably in equilibrium in the air like the self-fragmentable bullet of this invention as a result of the presence of passageways for the circulation of air longitudinally and its profiled skirt.

The invention will be further illustrated but is not limited by the following description in conjunction with the accompanying drawings:

Figure 2:
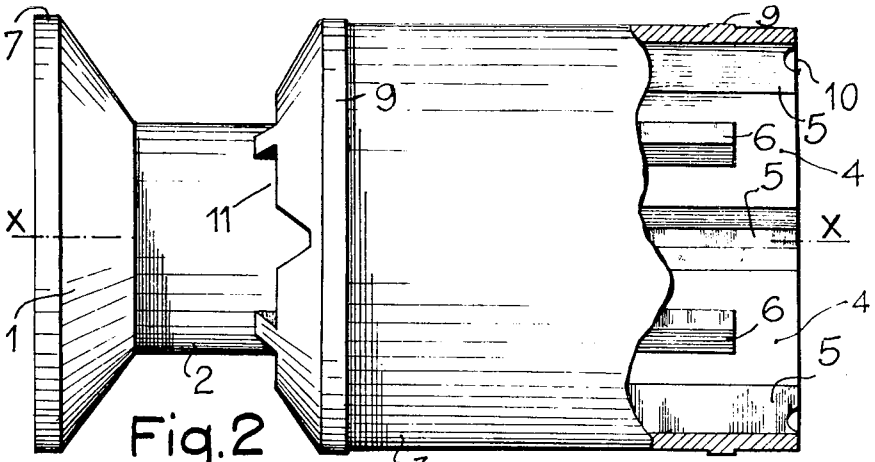
FIG. 2 is an elevational view, with parts broken away showing an embodiment of the invention.
Figure 4:
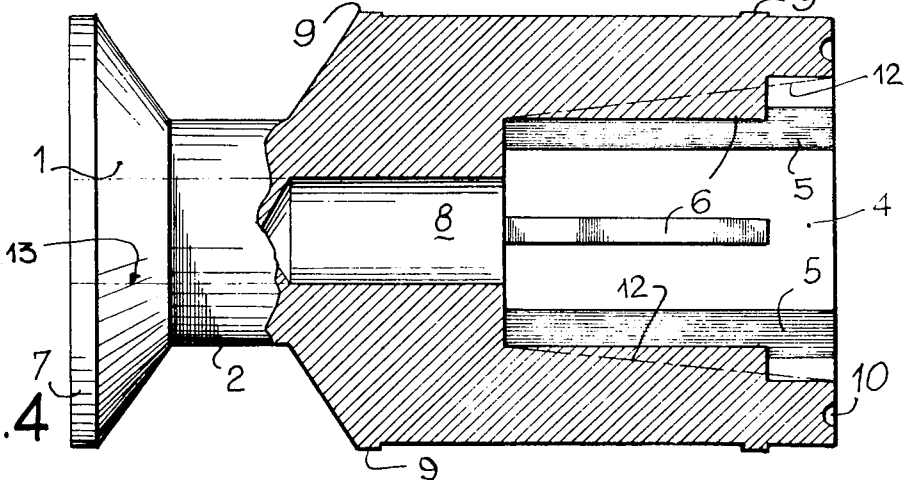
FIG. 4 is a view partly in section taken axially.
Figure 3:
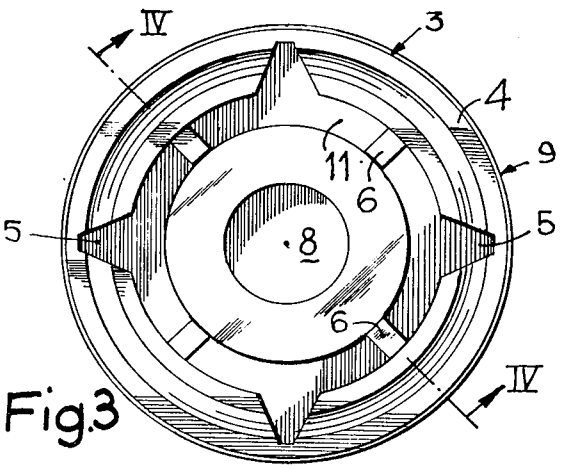
FIG. 3 is an end view.
Figure 1:
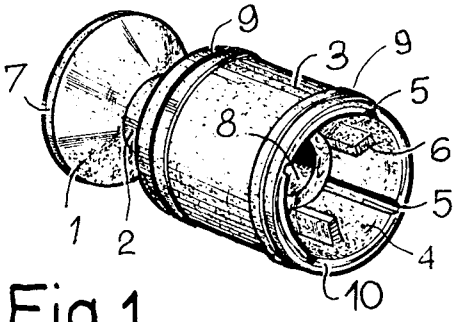
FIG. 1 is a perspective view of a bullet according to the present invention.

The bullet represented in the drawings presents a general revolution shape with an axis X—X which can be placed in a cylinder the height and the radius of which are given. It is made in the form of a block, and it is more especially constituted by a base 1 on which there axially projects a core 2 which is itself partially surrounded by a skirt which is formed of four panels 4 separated by notches 5 and connected to the core by means of small bars 6.

Base 1 is solid, and it presents the shape of a high convergent truncated cone, its large base forming a cylindrical belt 7 of limited height. Core 2 is constituted by a hollow cylindrical part which forms a blind hole 8, and the external and internal diameters of which very approximately correspond to one half and to one quarter of the total diameter, while its height also very approximately corresponds to one half of the total height.

Skirt 3 is constituted by a hollow cylindrical part, the internal diameter of which very approximately corresponds to threequarters of the total diameter, while its external diameter is slightly smaller than the latter. Its external surface which is perfectly smooth has a ring-shaped belt 9 limited in thickness close to each one of its ends, and the external diameter of which corresponds to the total diameter.

The skirt extends from approximately one-half the length of the core to the end of the bullet which is opposite the base, and it ends on the side of the core, by a base in the form of a convergent truncated cone having the same slant as the base, while its opposite base presents a ring-shaped groove, the section 10 of which is semicircular. Its internal cylindrical surface is interrupted by four notches which axially extend from one base to the other and which are placed at a 90° angle from one another, their cross-section presenting the form of a V, the opening of which is approximately 45° to 60° , while its depth is such that it is only approximately one-sixth of the thickness of the skirt. The notches 5 thus form the four skirt panels 4.

Small bars 6 which connect the core to the skirt are in the form of blades radially oriented between said core 2 and said skirt 3, and they are placed in the middle, in the direction of the circumference, of each one of panels 4 of said skirt, extending axially over all or part of the length of the skirt. Their thickness in the circumferential direction also is smaller than their radial dimension and it is further slightly reduced in the part located beyond core 2. Finally they form with the skirt and the core four axial passages 11 which are parallel to axis X—X.

The bullet is made all in one piece, by casting it of lead, tin and antimony alloy, or of any other material capable of being deformed and easily fragmented.

It is meant to be placed in a cartridge casing made of cardboard or of plastic material, the edge of which is set into groove 10.

It is especially advantageous for use in cartridges used for hunting big game.

When shooting with the help of such a cartridge, the bullet enters the animal, meeting a resistance which applies on it stresses, the result of which is to progressively deform it, in the manner of the opening of an umbrella, panels 4 moving apart from the core and from one another, by tearing at the level of notches 5, while maintaining solidarity of the core by means of small bars 6.

When the bullet does not meet any part harder than itself, it can run completely throughout the body of the animal, creating an exit opening of very important dimensions. It is necessary to note that the opening of the panels may, for example, double the diameter of the bullet, and consequently multiply by four the section of the passage. This results in a very important hemorrhage which reduces in proportion the distance the animal covers before dying.

If, on the other hand, the bullet meets a part harder than itself, such as a bone, it can break it, but it can also cause one or several of its own panels to be broken, which panels constitute fragments which remain at that location or which continue their trajectory, dispersing themselves throughout the body of the animal and causing mortal hemorrhages.

Moreover, when the bullet is on its shooting trajectory, it is stabilized by the presence of the small bars 6 and of the passages 11, the air flowing through the latter to come out again at the level of the base. The columns of air are perfectly parallel, and they reach the truncated cone shaped surface of the base which favors an even exhaust (it is necessary to note that the exit openings of the passages are smaller than their intake openings). Thus, there is obtained an excellent stability, and a trajectory which is practically horizontal and without any drift. The bullet, therefore, cannot turn over, an essential condition for it to arrive with its skirt to the bore in order for said skirt to play the part assigned to it through the opening of its panels.

The connecting small bars 6 assure a permanent solidarization of the core and of the skirt, so that the bullet cannot explode, and therefore is not dangerous for the hunter. It can be planned to progressively reduce, from one end to the other, in the axial direction, the thickness of said small bars in the radial direction, as schematically shown in mixed lines 12, the slant given to the small bars connected over their whole length on the skirt making possible the automatic loading of the bullet. The small bars may also be broken off at a point intermediary between the end of the core and the end of the skirt, in order to lighten the bullet.

The latter bullet is also made lighter by the provision of the blind hole 8, the lightening being a function of the depth of said hole. As a variation, a hole 13 is provided running through the whole bullet, including the base, something which also further increases the stability.

The three belts 7 and 9 are the only parts in contact with the barrel, and these are crushed while the bullet is being forced into said barrel, thus reducing the breaking action resulting from that phenomenon to a minimum. It is evident that the deformable nature of the material which constitutes the bullet also plays a part in this respect.

Finally, groove 10 also prevents the bullet from vibrating in the air, another factor increasing the stability of its trajectory already guided in depth and in direction by means of the small bars 6 and of the passages 11. The bullet is self-stabilizing.

It is evident that the present invention is not limited to the modes of application, nor to the modes of application which have been indicated. It would be possible to conceive several variations, without limiting the scope of the present invention. Particularly, the aforementioned bullet, the essential characteristic of which is to be fragmentable without being explosive, may comprise a skirt formed of several panels, the number of which would be different from four, in which case the notches 5, equal in number to the number of panels 4, still remain parallel with the longitudinal axis X—X. The shape of the notches is irrelevant. Similarly, the number of small bars 6 may vary, as well as their length relative to the length of the skirt, and as well as the slant of said small bars relative to axis X—X.

The invention is hereby claimed as follows:

1. A self-fragmented bullet comprising a block containing a central core, a peripheral part surrounding said core, said peripheral part comprising a plurality of panels extending longitudinally and separated by weakened areas which also extend longitudinally, and passageways between said peripheral part and said core extending from end to end of said block.

2. A bullet as claimed in claim 1 wherein said peripheral part comprises a cylindrical skirt connected to said core by small radial connecting bars.

3. A bullet as claimed in claim 1 wherein said weakened areas comprise notches extending longitudinally along said peripheral part.

4. A bullet as claimed in claim 1 wherein said peripheral part comprises a cylindrical skirt and said weakened areas comprise notches running longitudinally and formed in the inner surface of said skirt.

5. A bullet as claimed in claim 1 wherein said peripheral part comprises a skirt which extends only over a part of the length of said core and extends by itself beyond said core and said core comprises a base of substantially the same diameter as said skirt.

6. A bullet as claimed in claim 5 wherein said skirt comprises a plurality of ring-shaped belts on the exterior surface thereof and said base comprises a ring-shaped belt on the exterior surface thereof.

7. A bullet as claimed in claim 6 wherein all of said external ring-shaped belts have the same diameter.

8. A bullet as claimed in claim 5 wherein said base has the shape of a truncated cone converging in the direction of said skirt.

9. A bullet as claimed in claim 1 wherein said core is pierced with a central hole which is either a blind hole or a hole running throughout the core.

10. A bullet as claimed in claim 2 wherein said small bars in the radial direction are either constant in thickness or have a thickness which progressively decreases from the core toward the end of said skirt.

* * * * *